US006017381A

United States Patent [19]

Dunn et al.

[11] Patent Number: 6,017,381

[45] Date of Patent: Jan. 25, 2000

[54] FIELD EFFECT AUXILIARY GAS CYCLONE (FEAGC) AND METHOD OF USING

[75] Inventors: John P. Dunn, Hammondsport; Henri DeMoras, Rochester, both of N.Y.

[73] Assignee: Advance Electrostatic Technologies, Inc., Penn Yan, N.Y.

[21] Appl. No.: 09/037,551

[22] Filed: Mar. 9, 1998

[51] Int. Cl.[7] ..... B03C 3/15

[52] U.S. Cl. ..... 95/3; 95/58; 95/63; 95/78; 96/19; 96/52; 96/61; 96/74; 96/96

[58] Field of Search ..... 96/17, 18, 19, 96/52, 61, 74, 96; 95/2, 3, 58, 78, 63, 69, 70; 55/360

[56] References Cited

U.S. PATENT DOCUMENTS

| | | | |
|---|---|---|---|
| 1,773,840 | 8/1930 | Nattcher et al. | 96/61 |
| 1,843,839 | 2/1932 | Ruder | 96/61 |
| 2,081,772 | 5/1937 | Saint-Jacques | 96/61 X |
| 2,360,595 | 10/1944 | Thompson | 96/61 |
| 2,696,273 | 12/1954 | Wintermute | 96/61 |
| 3,970,437 | 7/1976 | Van Diepenbroek et al. | 96/61 |
| 3,988,128 | 10/1976 | Hogg | 96/61 X |
| 4,170,555 | 10/1979 | Vicard | 96/61 X |
| 4,352,681 | 10/1982 | Dietz | 96/61 |
| 4,588,423 | 5/1986 | Gillinghman et al. | 55/431 X |
| 5,591,253 | 1/1997 | Altman et al. | 96/61 |

FOREIGN PATENT DOCUMENTS

| | | | |
|---|---|---|---|
| 633607 | 11/1978 | U.S.S.R. | 96/61 |

*Primary Examiner*—Richard L. Chiesa
*Attorney, Agent, or Firm*—Brown, Pinnisi & Michaels, P.C.

[57] ABSTRACT

Collection of particles from a gas stream and the separation of dissimilar particles from a gas stream by a field effect auxiliary gas cyclone (FEAGC) is enhanced by providing an inductive field that attracts or repels particles and an auxiliary gas system that complements the field effect by providing an additional independent internal control for particle velocity, particle concentration, and system delta p. The FEAGC has three adjustable operating variables: (1) an auxiliary high pressure air input orifice located in the cyclone input which is used to increase the product velocity while reducing the solids to gas ratio; (2) an electric field between the cone and the vortex that subjects charged particles to either an attractive or repelling field; and (3) an auxiliary air venturi located in the inlet of the vortex to control the delta p and to control the operating temperature of the vortex and insulating materials. Controlling these variables is done by optically monitoring changes in the particle concentration at the exit end of the vortex outlet and automatically adjusting the auxiliary air inlets and the high voltage. The FEAGC is effective for separating particles that average less than 5 microns in diameter.

15 Claims, 7 Drawing Sheets

FIELD EFFECT AUXILIARY GAS CYCLONE (FEAGC) AND METHOD OF USING

FIELD OF THE INVENTION

The invention relates to a cyclone separator for collecting and separating particles from a gas stream, and in particular to a field effect auxiliary gas cyclone separator that separates particles based on material differences in electrical properties, density, and size of the particles.

BACKGROUND OF THE INVENTION

This technology is related to various chemical and mechanical industrial processes that need to collect, entrap, recover and separate solid particulates measuring five (5) microns or less from a dynamic gas system fine. Today, industry primarily depends on various types of wet scrubbers and filter and bag collectors to prevent fine particulates from escaping into the atmosphere. Recovery of materials collected in bag collectors is costly and may not be practical especially when processing food products that have limited shelf life. The handling and disposal of bags can also be difficult and costly. Wet scrubbers, while effective, are even more costly because of the additional liquid/solid extraction step and the additional cost of drying.

In a cyclone separator, a gas with particles therein, such as the smoke from a coal-fired power plant, enters a cylindrical or conical chamber tangentially and leaves axially. Because of the change in direction of the combined gas/particle mixture, the particles are flung to the outer wall, while the gasses whirl around to a central exit port. When a high percentage of fine particles are in the gas stream, the collection efficiency of a cyclone separator is poor. Cyclones have been electrostatically enhanced to improve performance. There are still disadvantages to known electrostatically enhanced cyclones.

U.S. Pat. Nos. 4,352,681 (Dietz), 4,588,423 (Gillingham et al.), and 5,591,253 (Altman et al.) disclose electrostatic dynamic separators that use internal corona charging methods to impart a charge on the particles to assist in the separation process. These cyclone separators effectively charge conductive and non-conductive particles because of the internal availability of both corona discharge electrodes and inductive electrodes. In many industrial processes that precede the cyclone in the gas stream flow, the particles are triboelectrically charged because of contact with dissimilar materials. If pre-charging is required, the particles pass through a corona field prior to entering the cyclone.

A disadvantage with using an internal corona discharge in the cyclone as described in the Dietz patent is that a corona discharge generates a corona wind that is difficult to keep symmetrical and uniform in a dust environment. In addition, the corona discharge adds an undesirable turbulence in situations where a streamlined flow is desired.

Altman et al. attempts to overcome some of the disadvantages of Dietz and Gillingham et al. by using slits to achieve a flow of a thin layer of material. The objectives are similar in that both devices try to achieve more effective methods for charging the particles of the entering gas stream.

Small cyclones come close to meeting the latest DOE "less than 2 micron" requirements and could be more cost effective then other systems if they were capable of remaining efficient as their size and through-put increases. A need exists for a cyclone that meets the latest DOE standards irrespective of size.

SUMMARY AND OBJECTS OF THE INVENTION

The invention includes a number of innovations that constitute an operating system when combined and integrated. The system combines auxiliary air inputs at both the input orifice and vortex outlet with a high voltage inductive field between the vortex and inner cone surface.

By using an internal polarized high voltage electrical field combined with an auxiliary air system, solid particles are effectively repelled to the outer wall of the cyclone for collection or modified to selectively attract specific particles to the inner vortex for separation. Collection is defined as the removal of all, or substantially all, solids from the gas/solids input stream. Separation refers to separating different solids from each other based on such characteristics as size, density, and electrical. Thermal properties tend to relate to electrical characteristics, so thermal separation does not truly occur in this context.

The primary purpose of the auxiliary air input system is to permit use of a high aspect ratio input orifice that allows the input flow to resemble as closely as possible a monolayer input of individual particles. However, with the narrower orifice, the pressure drop is excessive resulting in a reduction of the radial particle velocity and a low collection efficiency. In order to offset this problem, a tangential high velocity auxiliary air input system is added at the junction of the input orifice and the cone. Injecting high velocity air at this juncture increases particle velocity, reduces the solids to gas ratio, and restores the desired differential pressure of the system. Reducing the solid to gas ratio also has the effect of exposing more particles to the electrical field by reducing the blinding that occurs when the particle concentration is too high.

Briefly stated, collection of particles from a gas stream and the separation of dissimilar particles from a gas stream by a field effect auxiliary gas cyclone (FEAGC) is enhanced by providing an inductive field that attracts or repels particles and an auxiliary gas system that complements the field effect by providing an additional independent internal control for particle velocity, particle concentration, and delta p (pressure differential). The FEAGC has three adjustable operating variables: (1) an auxiliary high pressure air input orifice located in the cyclone input which is used to increase the product velocity while reducing the solids to gas ratio; (2) an electric field between the cone and the vortex that subjects charged particles to either an attractive or repelling field; and (3) an auxiliary air venturi located in the inlet of the vortex to control the delta p and to control the operating temperature of the vortex and insulating materials. Controlling these variables is done by optically monitoring changes in the particle concentration at the exit end of the vortex outlet and automatically adjusting the auxiliary air inlets and the high voltage.

According to an embodiment of the invention, an apparatus which collects and separates particles from a particle laden gas stream includes a cyclone cone; a vortex tube assembly axially centered within an upper portion of the cyclone cone; an apex outlet passage in a lower portion of the cyclone cone, whereby concentrated particles are removed from within the cyclone cone; a vortex passage within the vortex tube assembly, whereby gases, moisture, and ultra fine particles are removed from within the cyclone cone; a high aspect ratio angled input nozzle penetrating a wall of the cyclone cone, whereby the particle laden gas stream is admitted into the cyclone cone outside the vortex tube assembly; the cyclone cone and the vortex tube assembly being at different voltages so that an electric potential exists between the cyclone cone and the vortex tube assembly such that electrically charged particles having electrical characteristics within the gas stream are either attracted or repelled, respectively, depending on the electrical characteristics of the charged particles, and the cyclone cone being electrically grounded so that electrically charged particles are repelled from the vortex tube assembly, whereby the charged particles pass through the apex outlet passage.

According to an embodiment of the present invention, an apparatus which collects and separates particles from a particle laden gas stream includes a conical shaped vessel; an apex outlet passage at an apex of the vessel, whereby concentrated particles are removed from within the vessel; a vortex outlet vessel having a vortex passage therein, the vortex outlet vessel at an opposite end of the vessel from the apex, whereby gases, moisture, and ultra fine particles are removed from within the vessel; a high aspect ratio angled input nozzle penetrating a wall of the vessel, whereby the particle laden gas stream is admitted into the vessel; means, connected to the vortex outlet vessel, for establishing an electrostatic force between the conical vessel and the vortex outlet vessel which attracts or repels electrically charged particles from the vortex outlet vessel depending on the electrical characteristics of the particles, the conical vessel being electrically grounded wherein charged particles are repelled from the vortex outlet vessel and pass through the apex outlet passage, first and second auxiliary gas inputs, the first auxiliary gas input being in the input nozzle, wherein a velocity of the particles in the particle laden gas stream entering the conical vessel is adjustable, the second auxiliary gas input being in an inside of the vortex outlet vessel, wherein a pressure differential within the conical vessel is adjustable, wherein the particle laden gas stream flowing into the input nozzle is accelerated tangentially into the conical vessel by auxiliary gas flowing through the first auxiliary gas input, thereby imparting a centrifugal force on the particles towards a wall of the conical vessel, and wherein the centrifugal force is augmented by the electrostatic force that either maintains the particles against the wall of the conical vessel or attracts them to the apex outlet passage for separation and collection.

According to an embodiment of the invention, an apparatus which separates and collects particles from a particle laden solids/gas mixture includes a cyclone cone; a vortex tube assembly axially centered within an upper portion of the cyclone cone; an apex outlet passage in a lower portion of the cyclone cone, whereby concentrated particles are removed from within the cyclone cone; a vortex passage within the vortex tube assembly, whereby gases, moisture, and ultra fine particles are removed from within the cyclone cone; a high aspect ratio angled input nozzle penetrating a wall of the cyclone cone, whereby the solids/gas mixture is admitted into the cyclone cone outside the vortex tube assembly; means for controlling and varying a velocity of the particles within the cyclone cone; means for regulating and controlling an input particle to gas ratio of the solids/gas mixture as it enters the cyclone cone; means for controlling a differential pressure within the cyclone cone, and means for establishing an electrostatic force between the cyclone cone and the vortex tube assembly.

According to an embodiment of the present invention, an apparatus for collecting particles from a particle laden gas stream using a cyclone cone includes (a) means for monitoring changes in a particle concentration of the gas stream at a vortex outlet of the cyclone cone; (b) means for measuring a delta P of the cyclone cone between an input of the cyclone cone and the vortex outlet; (c) means for controlling, based on the particle concentration of the gas stream and the delta P, a velocity of the particle laden gas stream as the gas stream enters the cyclone cone; (d) means for subjecting, based on the particle concentration of the gas stream and the delta P, charged particles in the gas stream to one of an attractive and repelling electric field, (e) means for controlling, based on the particle concentration of the gas stream and the delta P, an operating temperature of the cyclone cone; and (f) means for separating said charged particles into at least first and second groups, wherein said particles in said first group have different conductivities from said particles in said second group.

According to an embodiment of the invention, an apparatus for separating particles from a particle laden gas stream, with a portion of the particles having a first conductivity and another portion of the particles having a second conductivity, with the first conductivity being lower than the second conductivity, includes a cyclone cone; a vortex tube assembly axially centered within an upper portion of the cyclone cone; a high aspect ratio angled input nozzle penetrating a wall of the cyclone cone, whereby the particle laden gas stream is admitted into the cyclone cone outside the vortex tube assembly; an apex outlet passage in a lower portion of the cyclone cone, whereby concentrated particles of the first conductivity are removed from within the cyclone cone; a vortex passage within the vortex tube assembly, whereby gases, moisture, ultra fine particles, and particles of the second conductivity are removed from within the cyclone cone; a cone shaped circular array of wires, the array extending from an end of said vortex tube assembly to a ring disposed between the vortex tube assembly and the apex outlet passage, wherein an electric field between the array and the cyclone cone induces an intermittent drag component on the gas stream such that charged particles are attracted into an inner exhaust gas vortex for separation through the vortex passage; and the cyclone cone and the vortex tube assembly having different voltage potentials such that particles of the second conductivity are attracted to the vortex passage and removed from within the cyclone cone.

According to an embodiment of the present invention, a method for collecting particles from a particle laden gas stream using a cyclone cone includes the steps of (a) monitoring changes in a particle concentration of the gas stream at a vortex outlet of the cyclone cone; (b) measuring a delta P of the cyclone cone between an input of the cyclone cone and the vortex outlet; (c) controlling, based on results of the steps of monitoring and measuring, a velocity of the particle laden gas stream as the gas stream enters the cyclone cone; (d) subjecting, based on results of the steps of monitoring and measuring, charged particles in the gas stream to one of an attractive and repelling electric field, (e) controlling, based on results of the steps of monitoring and measuring, an operating temperature of the cyclone cone; and (f) separating the charged particles into at least first and second groups, wherein the particles in the first group have different conductivities from the particles in the second group..

DESCRIPTION OF THE PREFERRED EMBODIMENT

Figure 1A:
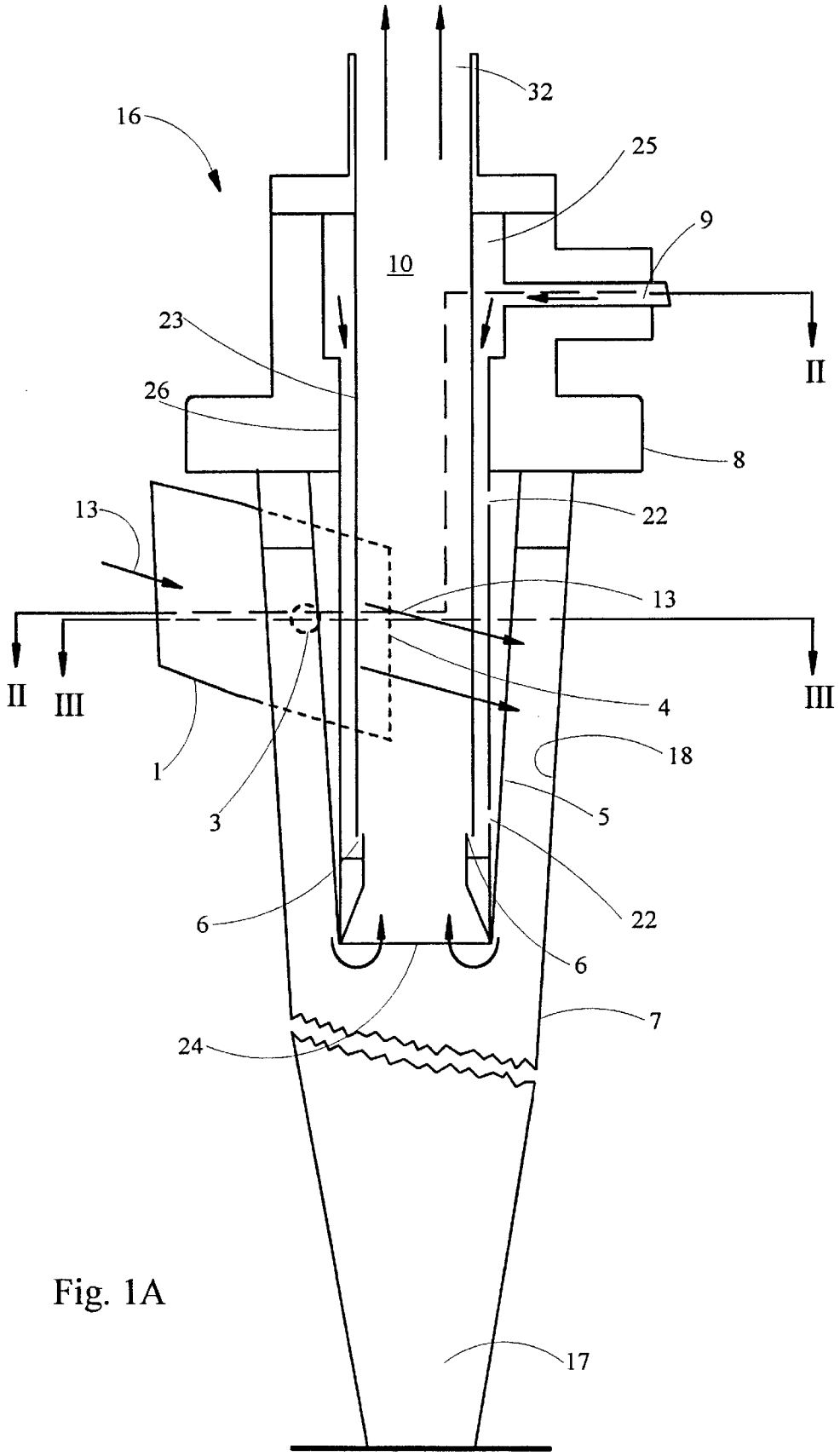
FIG. 1A is a sectional elevation view showing an embodiment of the electrostatic field effect auxiliary gas cyclone of the present invention.
Figure 2:
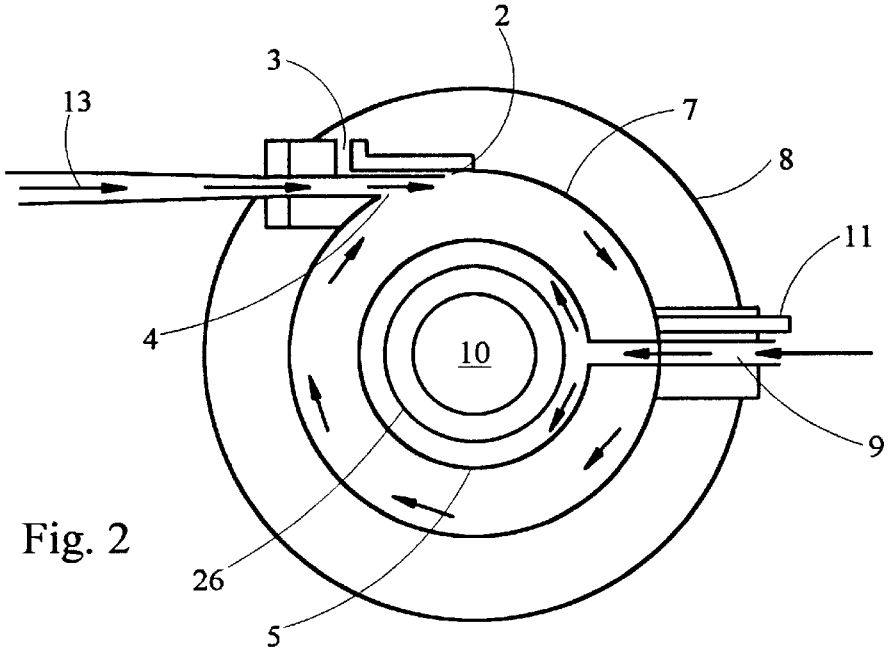
FIG. 2 is a cross-sectional view taken along the line II—II of FIG. 1 showing an embodiment of the auxiliary gas straight input orifice and the auxiliary vortex gas input.

Referring to FIGS. 1A and 2, a field effect auxiliary gas cyclone (FEAGC) 16 includes a cyclone cone 7 with a vortex tube assembly 10 coaxially and centrally located in an upper portion thereof An inclined high aspect ratio solids/gas input nozzle 1 terminates inside cone 7 with a solids/gas mixture input orifice 4. Vortex tube assembly 10 includes a vortex outlet cone 5 with an outer vortex tube 26 and an inner vortex tube 23 concentrically arranged inside vortex outlet cone 5. A vortex air input 9 feeds air into a distribution chamber 25. Distribution chamber 25 is fluidly connected to the hollow area between inner vortex tube 23 and outer vortex tube 26. The air brought into FEAGC 16 through vortex air input 9 flows into the interior of inner vortex tube 23 through a vortex auxiliary gas input orifice 6. The suction created by the air passing through orifice 6 draws the separated gasses from cyclone cone 7 through vortex orifice 24 and outside FEAGC 16 at a vortex outlet 32.

An upper dielectric support block 8, where a high-voltage source is attached to vortex tube assembly 10, is disposed so that it forms an upper boundary for the vortex area between vortex tube assembly 10 and cyclone cone 7. A solids exit apex 17 provides a collection point for the solids that are "spun out" of cyclone cone 7 during the separation process.

A plurality of annular vent holes 22 are a series of circular orifices preferably spaced apart on ½ inch centers. Holes 22 allow gas to flow from distribution chamber 25 into a chamber formed between inner vortex tube 23 and outer vortex tube 26. Gas that flows through this chamber is dependent on a thermal gradient that develops between vortex outlet cone 5 and the interior of the vortex. The flow path of least resistance is between inner vortex tube 23 and outer vortex tube 26, while the gas flow in the chamber is the result of convention flow.

Figure 1B:
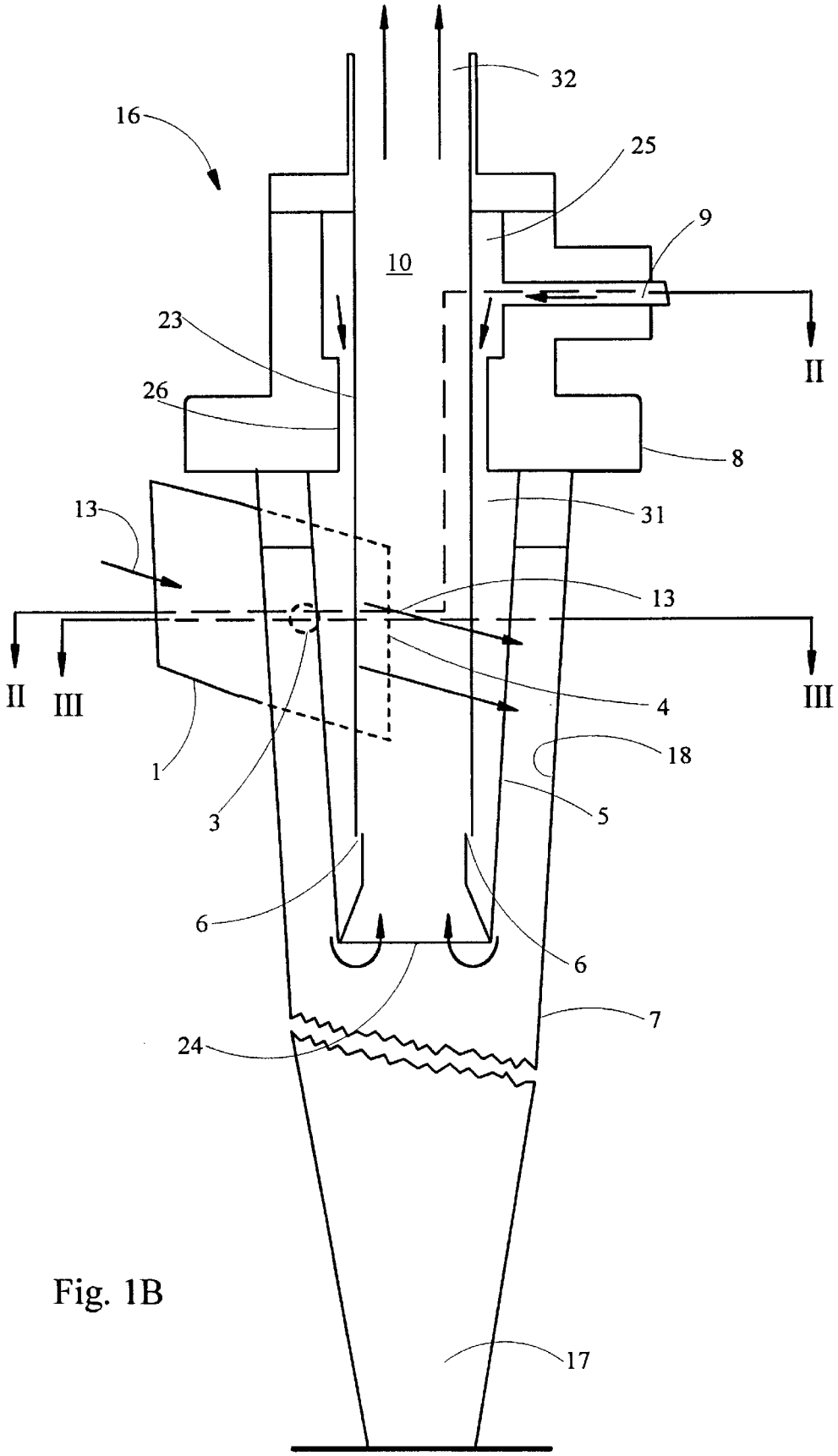
FIG. 1B is a sectional elevation view showing an embodiment of the electrostatic field effect auxiliary gas cyclone of the present invention.

Referring also to FIG. 1B, a more recent design embodiment of FEAGC 16 eliminates the lower section of inner vortex tube 26, thus allowing for improved heat transfer at an inner surface of vortex outlet cone 5. Other details of the embodiment of FIG. 1B are the same as FIG. 1A.

A solids/gas mixture 13 enters cyclone cone 7 via input nozzle 1 and orifice 4 at an angle preferably between 0 and 15 degrees, tangentially to the inner cone surface of cyclone cone 7, thereby causing the solids/gas mixture to flow in a spiral path towards apex 17 of cyclone cone 7. Separation of the gas from the solids occurs because of density differences. Since the gas is lower in density than the solids, it loses its momentum first and moves towards the vortex surface and the center axis of the cyclone where a reverse gas vortex forms extending up into the inside of the vortex outlet tube 10. FEAGC 16 enhances this separation process by applying an electric force 19 that acts as either an attracting or repelling force the length of vortex tube assembly 10 to cause pre-charged non-conductive or conducive particles to remain against the inner cyclone wall of cyclone cone 7 or be attracted to the outer surface of vortex outlet cone 5. Particles can be pre-charged before entering FEAGC 16 using conventional triboelectric or corona discharge techniques.

There are thus two spiral vortexes inside FEAGC 16. One spiral vortex begins with solids/gas mixture 13 and spirals downward, eventually reaching apex 17 where the heavier and more massive solids in solids/gas mixture 13 are collected. The other spiral is the reverse gas vortex that extends from near apex 17 upwards through vortex tube assembly 10 and out of FEAGC 16.

The response of the particulates to the electric field is improved by adding an auxiliary gas system that effects particle velocity, particle concentration, and delta p of the system. Two embodiments of auxiliary air orifices are presented herein: the straight orifice and the angular orifice.

Figure 3:
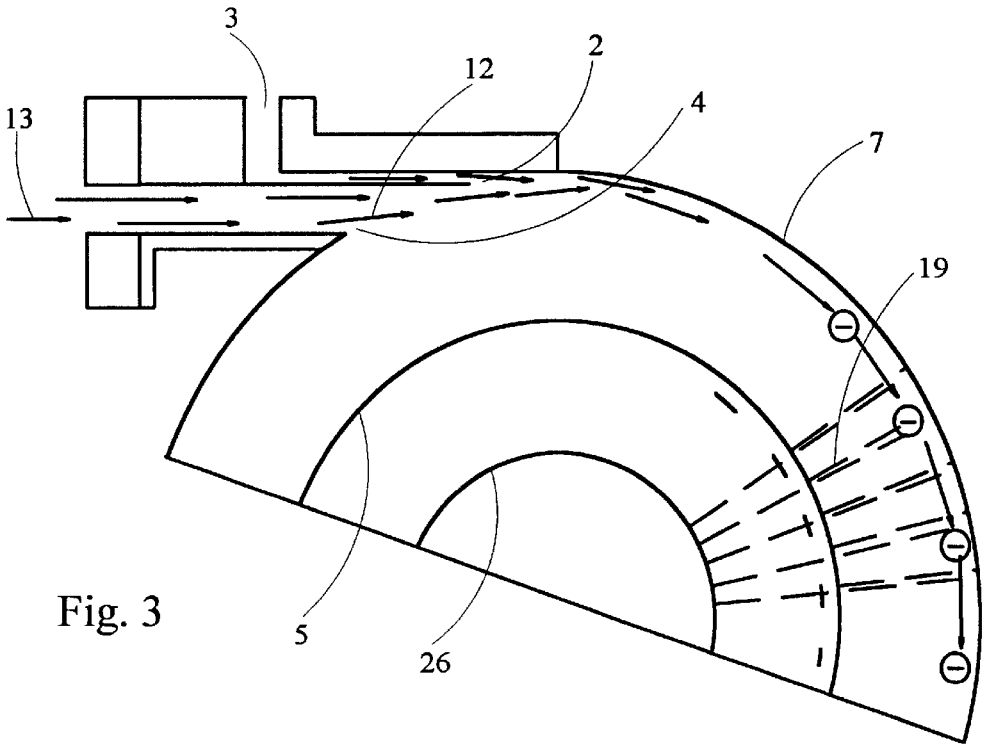
FIG. 3 is an enlarged cross- sectional view of an embodiment of the auxiliary gas input orifice showing a straight orifice.

Referring also to FIG. 3, a low volume of high velocity air is injected into cyclone cone 7 via an auxiliary gas input 3 and auxiliary gas straight input orifice 2. Orifice 2 directs the incoming solids/gas mixture 13 so that it enters cone 7 tangentially along the inner surface of cone 7 and parallel to the existing particulates swirling around inside cone 7. Orifice 2 functions to lower the gas pressure at the point of entry by introducing a small quantity of gas 15 at several times the particle input velocity. The high velocity gas 15 attracts the incoming particles towards the inner surface of cone 7 and serves to reduce turbulence, while at the same time, attenuating the main incoming flow of solids/gas mixture 13 and decreasing the solids concentration in mixture 13. Lowering the solids to gas ratio reduces the particle concentration and results in less blinding of the smaller particles by the larger particles. In addition, the high voltage electrostatic field 19 becomes more effective in attracting or repelling particles.

Figure 4:
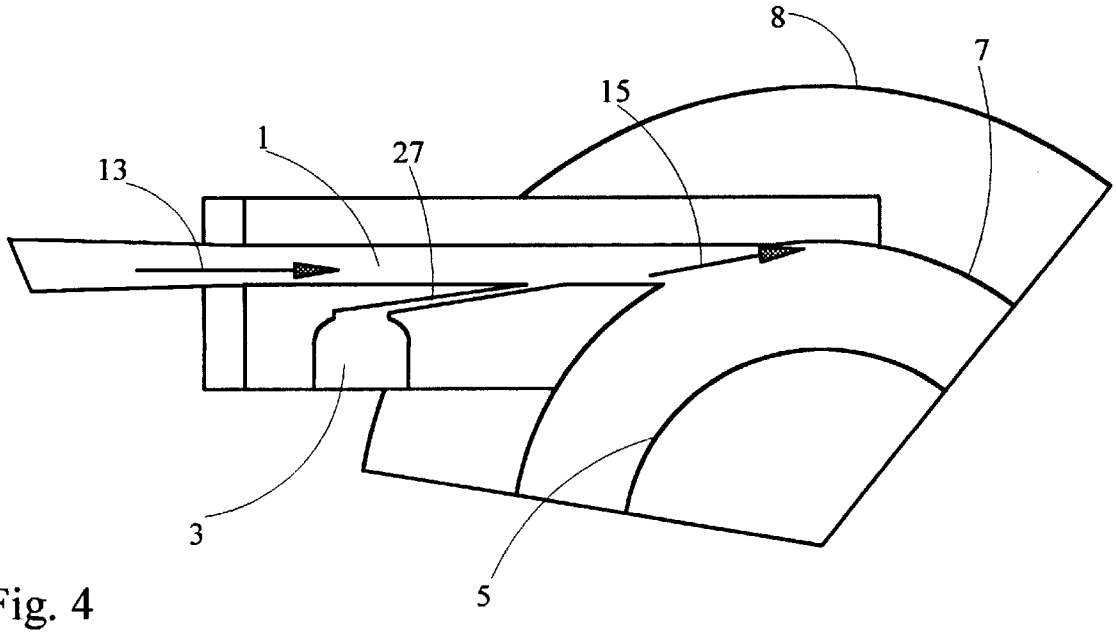
FIG. 4 is an enlarged cross-sectional view of an embodiment of the auxiliary gas input orifice showing an angled input orifice.

Referring also to FIG. 4, a low volume of high velocity air is injected into cyclone cone 7 via an auxiliary gas input 3 and auxiliary gas angular orifice 27. The high velocity air from orifice 27 cuts across the path of the incoming particles in mixture 13 tangentially to cyclone cone 7. The high velocity gas entering through auxiliary gas angular orifice 27 shears and breaks down any clusters of powder in mixture 13 coming into cyclone cone 7.

The size of orifice 2 or orifice 27 can be varied to ensure proper velocity. The smaller the orifice, the greater the velocity. A relatively high velocity of the gas is desired, but having a large volume of gas entering the system is undesirable. For this reason, increasing the gas flow to increase the velocity is not preferred.

In the embodiments of orifices as shown in FIGS. 3–4, the delta p (change in pressure, or pressure differential) must be high enough to prevent turbulent flow in the cyclone but not so high as to adversely affect collection efficiency. The overall pressure drop (delta p) for FEAGC 16, is measured at the entrance of input nozzle 4 and vortex outlet 32. The total pressure drop in a cyclone system is equal to the pressure drop due to centrifugal action plus the kinetic pressure at the inlet, input nozzle 4, plus the pressure drop at the outlet, vortex outlet 32, minus the kinetic pressure recovered and the pressure drop due to position. The kinetic pressure refers to the motion of gas atoms that results in either a positive or negative pressure within the system. Generally kinetic pressure is not recovered and leads to a pressure drop and loss in the tangential particle velocity. The pressure drop due to position is negligible due to the relatively short lengths of cyclones.

The pressure drop across FEAGC 16 is directly related to the entering velocity and density of the gas/solids mixture. The auxiliary air systems of FIGS. 3 and 4 are incorporated into input orifice 4 to have some internal control of the pressure drop in order to maintain the desired velocity components of FEAGC 16, and to achieve a solids/gas mixture input that resembles a monolayer of discrete particles flowing into FEAGC 16. A monolayer operating system allows the high voltage electric field 19 to have a greater influence on the lateral movement of the particles between electrodes, thereby achieving a more efficient separation or collection of the particles from the gas. That is, an input flow pattern resembling a monolayer of solid particles can be efficiently separated by either attracting or repelling forces when exposed to electric field 19.

Figure 5A:
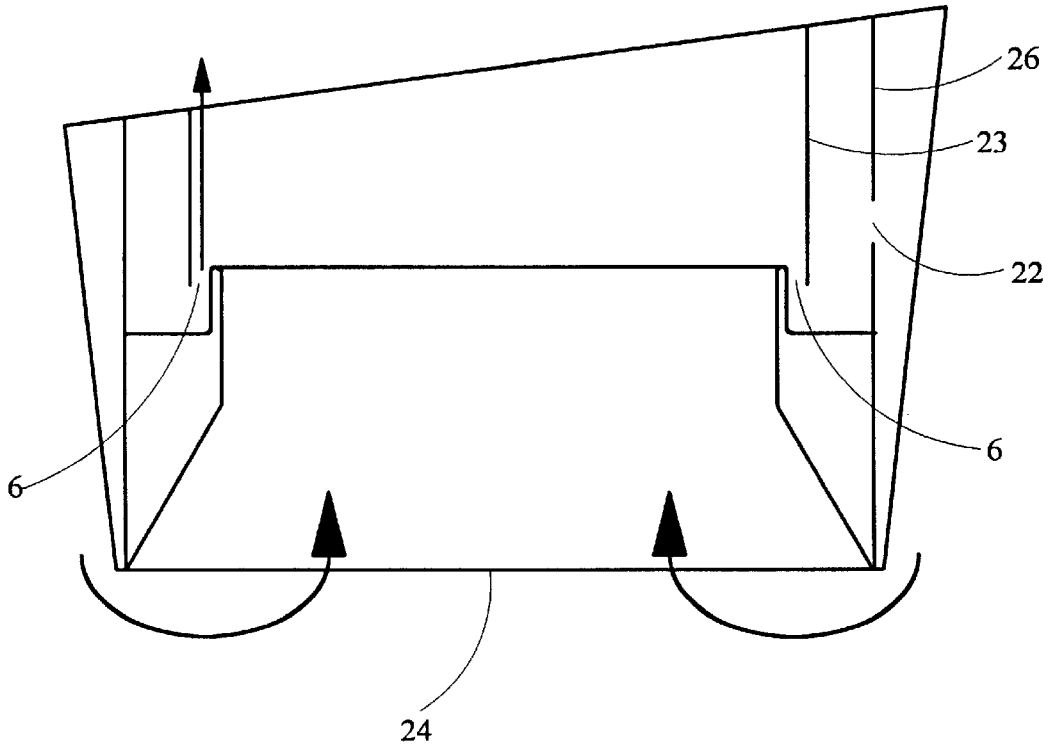
FIG. 5A shows an enlarged partial cross-sectional view of the vortex auxiliary gas input orifice of the embodiment shown in FIG. 1A.

Referring to FIG. 5A, a detailed view of the annular vortex auxiliary gas input orifice 6 is shown. Gas under high pressure but low volume exits orifice 6 adjacent to the inner wall of inner vortex tube 23 at a high velocity, thereby creating a negative pressure at vortex orifice 24. Having this auxiliary gas system permits the adjustment and maintenance of a desired pressure differential when the product load varies or other operating parameters change.

Figure 5B:
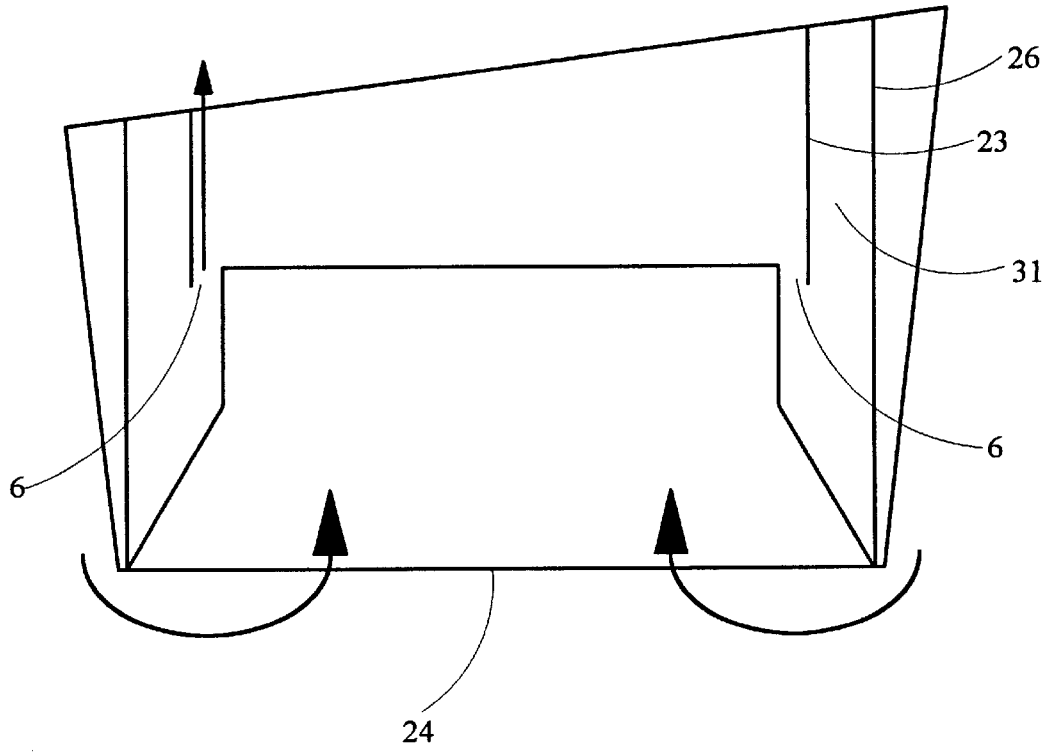
FIG. 5B shows an enlarged partial cross-sectional view of the vortex auxiliary gas input orifice of an embodiment shown in FIG. 1B.

Referring to FIG. 5B, the embodiment of FIG. 1B eliminates the lower section of inner vortex tube 26, thus allowing for improved heat transfer at the inner surface of vortex outlet cone 5. As shown in FIG. 1B, the gas entering vortex air input 9 enters distribution chamber 25. The gas then enters vortex inner chamber 31 due to the elimination of the lower section of inner vortex tube 26. Gas under high pressure but low volume exits orifice 6 adjacent to the inner wall of inner vortex tube 23 at a high velocity, thereby creating a negative pressure at vortex orifice 24. As with the FIG. 5A embodiment, this auxiliary gas system permits the adjustment and maintenance of a desired pressure differential. Vortex auxiliary gas input orifice 6 is thus an aspirator in the vortex outlet tube which has the dual purpose of maintaining delta p and keeping the dielectric components at a lower operating temperature, thereby retaining the electrical properties of the dielectric materials.

The size of orifice 6 can be varied as necessary for the particular cyclone system. Reducing the size of the orifice increases the velocity, which in turn causes lower pressure in the vortex. Lower pressure in the vortex acts to speed up the velocity of the solids/gas mixture 13 entering the system. Orifice 6 increases the velocity of the gasses exiting the system by approximately 1.5 to 3 times. This increased airflow increases cooling within the system. It is also possible to have an adjustable orifice so the size can be varied as needed. Having a variable orifice permits using the same cyclone system for different waste gas streams.

Figure 6:
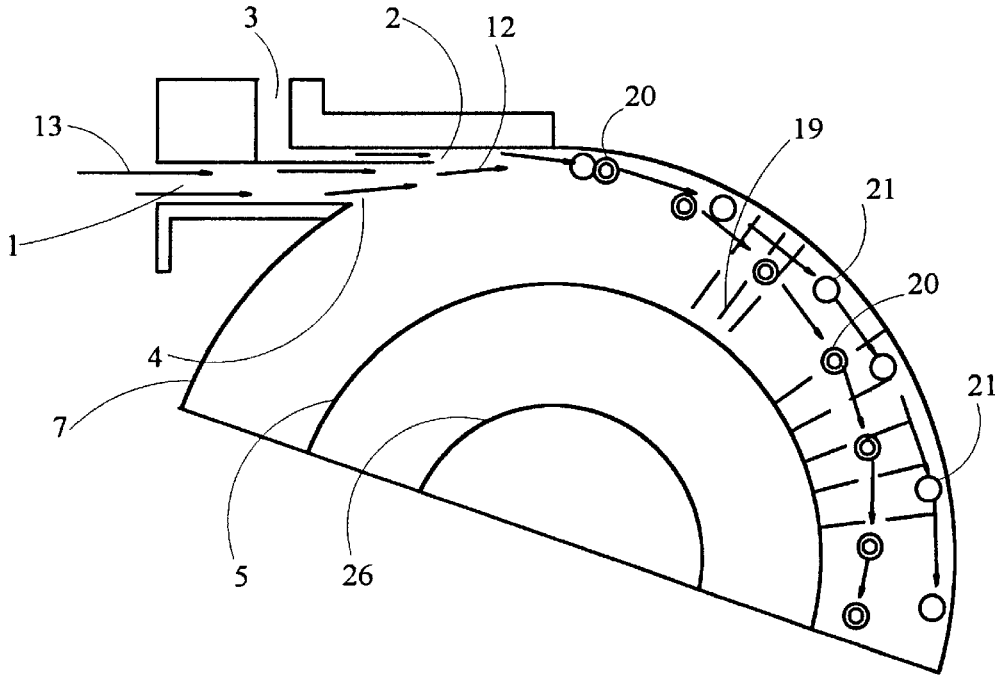
FIG. 6 is a partial cross-sectional view showing one embodiment of the electrostatic field effect used for the separation of dissimilar particulates.

Referring to FIG. 6, the effect of the electrostatic field 19 on the separation of conductive particles 20 and nonconductive particles 21 as they spiral down between cone 7 and vortex outlet cone 5 is shown. For illustrative purposes, if vortex outlet cone 5 has a negative charge while cone 7 is grounded, the electric field 19 exerts a lateral repelling or attractive force on the moving particles depending on the charge polarity of the solid particles. Field 19 is perpendicular to the moving particles and adds an additional drag factor to the movement of the particles, thereby tending to reduce the tangential velocity of the particles having the higher electrical charge. The combination of the attracting field and the drag factor accounts for the ability of FEAGC 16 to separate dissimilar materials. The direct current electrostatic field 19 selectively attracts the more conductive, higher dielectric constant particles 20 to the inner overflow vortex and allows the nonconductive particles 21 to be collected at apex 17 of the cyclone. The separation effect is enhanced by increasing the diameter of cone 7, since the particles 20, 21 spend more time inside field 19.

Figure 7:
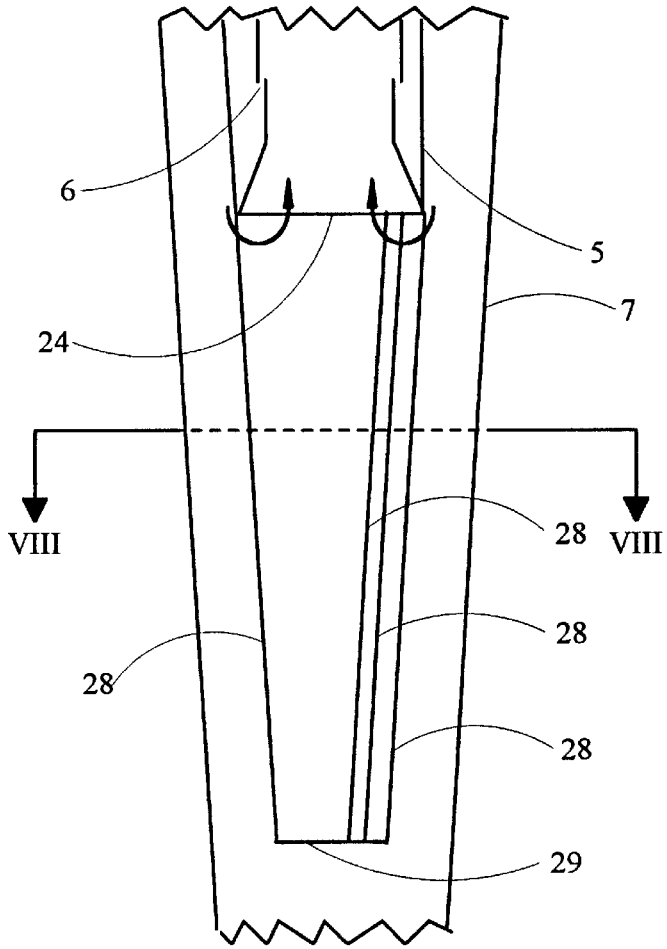
FIG. 7 is a partial cross-sectional view showing an embodiment of the electrostatic field effect electrode that uses an array of wires attached to the vortex electrode.

Referring to FIG. 7, an array of wire electrodes 28 follow the contour of the vortex assembly, attaching physically and electrically to vortex orifice 24 on one end and a lower ring 29 on the other. Wire electrodes 28 are at the same potential as vortex tube assembly 10, whereas cyclone cone is preferably grounded. The diameters of wire electrodes 28 are preferably large enough to prevent a corona discharge but small enough to offer low impedance to flow. When wire electrodes 28 are charged, they produce an asymmetrical attractive or repulsive field that flares out in the pattern shown in FIG. 8 that induces a series of high intensity pulses on the spiraling particles. This results in added turbulence and drag on the particles, thus exposing other charged particles that can be attracted to the inner vortex for separation.

Figure 8:
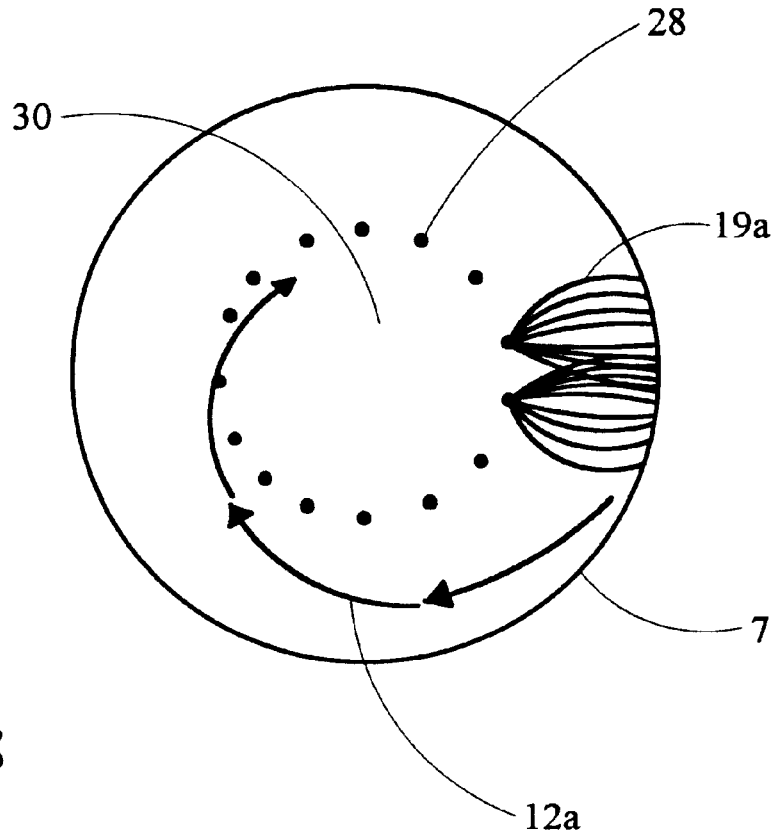
FIG. 8 is a cross-sectional view taken along the line VIII—VIII of FIG. 7, showing the intermittent flux lines produced by the array of wires attached to the vortex electrode.

Referring to FIG. 8, electric field 19*a* is created by the wire electrodes 28. The solids in solids/gas flow 12*a* are subjected to gradient electric field 19*a*, which creates a disturbance to the radial flow of the particles in solids/gas flow 12*a*, with the desired effect of exposing additional particles that can be electrically attracted to the upwardly spiraling inner vortex spiral 30 inside the array of electrodes 28. Electric fields 19 (FIGS. 3, 6) and 19*a* thus provide an effect that is substantially continuous throughout the length of cone 7, thereby permitting easy separation of a semiconductor from a nonconductor or a conductor from a semiconductor. If the particles are of different size, the present invention can separate particles having a dielectric constant of 10 or 20 from particles having a dielectric constant of 6. For example, particles of materials such as topaz, calcite, aragonite, barite, and quartz, which have dielectric constants between 5.29 and 7.86, can be separated from particles of mica (10.00) and stibnite (11.15), as can sulphur (3.62). Carbon, semiconductors, and all metals are also separable. Although not yet tested, fluorite, gypsum, celestite, orthoclase, anhydrite, berel, and sphalerite should also be separable from mica. This feature of separation in addition to collection is useful in industrial applications.

The present invention is effective for separating particles that average less than 5 microns in diameter by controlling and varying the particle velocity within the cyclone, regulating and controlling the input particle to gas ratio, controlling the differential pressure (delta p or operating pressure) within the cyclone, and adding a lateral attractive/repulsive electrical force. FEAGC 16 has three adjustable operating variables: (1) auxiliary high pressure gas input orifice 3 or 27 located in the cyclone input which is used to increase the product velocity while reducing the solids to gas ratio of solids/gas mixture 13; (2) a means for providing an electric field between cone 7 and vortex cone 5 that subjects charged particles to either an attractive or repelling field; and (3) an auxiliary air venturi such as vortex auxiliary gas input orifice 6 located in the inlet of the vortex to control the delta p and also the operating temperature of the vortex and insulating materials. Controlling these variables is preferably done by optically monitoring changes in the particle concentration at vortex outlet 32 and automatically adjusting the auxiliary air inlets and the high voltage.

We claim:

1. An apparatus which collects and separates particles from a particle laden gas stream, comprising:

a cyclone cone;

a vortex tube assembly axially centered within an upper portion of said cyclone cone;

an apex outlet passage in a lower portion of said cyclone cone, whereby concentrated particles are removed from within said cyclone cone;

a vortex passage within said vortex tube assembly, whereby gases, moisture, and ultra fine particles are removed from within said cyclone cone;

a high aspect ratio angled input nozzle penetrating a wall of said cyclone cone, whereby said particle laden gas stream is admitted into said cyclone cone outside said vortex tube assembly;

said cyclone cone and said vortex tube assembly being at different voltages so that an electric potential exists between said cyclone cone and said vortex tube assembly such that electrically charged particles having electrical characteristics within said gas stream are either attracted or repelled, respectively, depending on said electrical characteristics of said charged particles; and said cyclone cone being electrically grounded so that electrically charged particles electrically polarized similar to an electric polarity of said vortex tube assembly are repelled from said vortex tube assembly, whereby said charged particles pass through said apex outlet passage.

2. An apparatus according to claim 1, further comprising a cone shaped circular array of wires, said array extending from an end of said vortex tube assembly to a ring disposed between said vortex tube assembly and said apex outlet passage, wherein an electric field between said array and said cyclone cone induces an intermittent drag component on said gas stream such that charged particles are attracted into an inner exhaust gas vortex for separation through said vortex passage.

3. An apparatus according to claim 1, wherein an outside of said vortex tube assembly is conical in shape and substantially congruent to said cyclone cone, such that said electric potential between said vortex tube assembly and said cyclone cone is substantially uniform.

4. An apparatus which collects and separates particles from a particle laden gas stream, comprising:

a conical shaped vessel;

an apex outlet passage at an apex of said vessel, whereby concentrated particles are removed from within said vessel;

a vortex outlet vessel having a vortex passage therein, said vortex outlet vessel at an opposite end of said vessel from said apex, whereby gases, moisture, and ultra fine particles are removed from within said vessel;

a high aspect ratio angled input nozzle penetrating a wall of said vessel, whereby said particle laden gas stream is admitted into said vessel;

means, connected to said vortex outlet vessel, for establishing an electrostatic force between said conical vessel and said vortex outlet vessel which attracts or repels electrically charged particles from the vortex outlet vessel depending on the electrical characteristics of the particles;

said conical vessel being electrically grounded wherein charged particles electrically polarized similar to an electric polarity of said vortex outlet vessel are repelled from said vortex outlet vessel and pass through the apex outlet passage;

first and second auxiliary gas inputs;

said first auxiliary gas input in said input nozzle, wherein a velocity of said particles in said particle laden gas stream entering said conical vessel is adjustable;

said second auxiliary gas input in an inside of said vortex outlet vessel, wherein a pressure differential within said conical vessel is adjustable;

wherein said particle laden gas stream flowing into said input nozzle is accelerated tangentially into said conical vessel by auxiliary gas flowing through said first auxiliary gas input, thereby imparting a centrifugal force on the particles towards a wall of the conical vessel; and wherein the centrifugal force is augmented by said electrostatic force that either maintains the particles against said wall of said conical vessel or attracts them to the apex outlet passage for separation and collection.

5. An apparatus according to claim 4, further comprising a cone shaped circular array of wires, said array extending from an end of a vortex tube assembly to a ring disposed between said vortex tube assembly and said apex outlet passage, wherein an electric field between said array and said conical shaped vessel induces an intermittent drag component on said gas stream such that charged particles are attracted into an inner exhaust gas vortex for separation through said vortex passage.

6. An apparatus which collects and separates particles from a particle laden solids/gas mixture, comprising:

a cyclone cone;

a vortex tube assembly axially centered within an upper portion of said cyclone cone;

an apex outlet passage in a lower portion of said cyclone cone, whereby concentrated particles are removed from within said cyclone cone;

a vortex passage within said vortex tube assembly, whereby gases, moisture, and ultra fine particles are removed from within said cyclone cone;

a high aspect ratio angled input nozzle penetrating a wall of said cyclone cone, whereby said solids/gas mixture is admitted into said cyclone cone outside said vortex tube assembly;

first means for controlling and varying a velocity of said particles within said cyclone cone;

second means for controlling a differential pressure within said cyclone cone; and third means for establishing an electrostatic force between said cyclone cone and said vortex tube assembly.

7. An apparatus according to claim 6, wherein said first means also regulates and controls an input particle to gas ratio of said solids/gas mixture as it enters said cyclone cone.

8. An apparatus according to claim 6, wherein said first means includes an auxiliary gas input in said input nozzle, wherein said particle laden gas stream flowing into said input nozzle is accelerated tangentially into said cyclone cone by auxiliary gas flowing through said auxiliary gas input, thereby imparting a centrifugal force on the particles towards a wall of said cyclone cone.

9. An apparatus according to claim 6, wherein said second means includes an auxiliary gas input substantially near a lower end of said vortex passage.

10. An apparatus according to claim 6, wherein said third means includes a high voltage source connected to said vortex tube assembly.

11. An apparatus according to claim 6, further comprising a cone shaped circular array of wires, said array extending from an end of said vortex tube assembly to a ring disposed between said vortex tube assembly and said apex outlet passage, wherein an electric field between said array and said cyclone cone induces an intermittent drag component on said gas stream such that charged particles are attracted into an inner exhaust gas vortex for separation through said vortex passage.

12. An apparatus according to claim 6, further comprising fourth means for controlling a length of time charged particles are in said electrostatic force.

13. An apparatus for collecting and separating particles from a particle laden gas stream using a cyclone cone, comprising:

a) means for monitoring changes in a particle concentration of said gas stream at a vortex outlet of said cyclone cone;

b) means for measuring a delta p of said cyclone cone between an input of said cyclone cone and said vortex outlet;

c) means for controlling, based on said particle concentration of said gas stream and said delta p, a velocity of said particle laden gas stream as said gas stream enters said cyclone cone;

d) means for subjecting, based on said particle concentration of said gas stream and said delta p, charged particles in said gas stream to one of an attractive and repelling electric field;

e) means for controlling, based on said particle concentration of said gas stream and said delta p, an operating temperature of said cyclone cone; and f) means for separating said charged particles into at least first and second groups, wherein said particles in said first group have different conductivities from said particles in said second group.

14. An apparatus for separating particles from a particle laden gas stream, a portion of said particles having a first conductivity and another portion of said particles having a second conductivity, said first conductivity being lower than said second conductivity, comprising:

a cyclone cone;

a vortex tube assembly axially centered within an upper portion of said cyclone cone;

a high aspect ratio angled input nozzle penetrating a wall of said cyclone cone, whereby said particle laden gas stream is admitted into said cyclone cone outside said vortex tube assembly;

an apex outlet passage in a lower portion of said cyclone cone, whereby concentrated particles of said first conductivity are removed from within said cyclone cone;

a vortex passage within said vortex tube assembly, whereby gases, moisture, ultra fine particles, and particles of said second conductivity are removed from within said cyclone cone;

a cone shaped circular array of wires, said array extending from an end of said vortex tube assembly to a ring disposed between said vortex tube assembly and said apex outlet passage, wherein an electric field between said array and said cyclone cone induces an intermittent drag component on said gas stream such that charged particles are attracted into an inner exhaust gas vortex for separation through said vortex passage; and said cyclone cone and said vortex tube assembly having different voltage potentials such that particles of said second conductivity are attracted to said vortex passage and removed from within said cyclone cone.

15. A method for collecting particles from a particle laden gas stream using a cyclone cone, comprising the steps of:

a) monitoring changes in a particle concentration of said gas stream at a vortex outlet of said cyclone cone;

b) measuring a delta p of said cyclone cone between an input of said cyclone cone and said vortex outlet;

c) controlling, based on results of the steps of monitoring and measuring, a velocity of said particle laden gas stream as said gas stream enters said cyclone cone;

d) subjecting, based on results of the steps of monitoring and measuring, charged particles in said gas stream to one of an attractive and repelling electric field;

e) controlling, based on results of the steps of monitoring and measuring, an operating temperature of said cyclone cone; and f) separating said charged particles into at least first and second groups, wherein said particles in said first group have different conductivities from said particles in said second group.

* * * * *